US009132986B2

(12) United States Patent
Balzanelli

(10) Patent No.: US 9,132,986 B2
(45) Date of Patent: Sep. 15, 2015

(54) METHOD FOR PRECISELY CUTTING TO SIZE TUBES WOUND ONTO A SPOOL AND MACHINE FOR IMPLEMENTING SAID METHOD

(71) Applicant: F.B. BALZANELLI AVVOLGITORI S.P.A., Milan (IT)

(72) Inventor: Alessandro Balzanelli, Milan (IT)

(73) Assignee: F.B. BALZANELLI AVVOLGITORI S.P.A., Milan (IT)

( * ) Notice: Subject to any disclaimer, the term of this patent is extended or adjusted under 35 U.S.C. 154(b) by 254 days.

(21) Appl. No.: 13/764,222

(22) Filed: Feb. 11, 2013

(65) Prior Publication Data

US 2013/0214082 A1 Aug. 22, 2013

(30) Foreign Application Priority Data

Feb. 16, 2012 (IT) ..... MI2012A0229

(51) Int. Cl.

| | |
|---|---|
| ***B65H 54/00*** | (2006.01) |
| ***B65H 61/00*** | (2006.01) |
| ***B26D 3/16*** | (2006.01) |
| ***B26D 5/34*** | (2006.01) |
| ***B26D 1/06*** | (2006.01) |
| ***B26D 5/32*** | (2006.01) |
| ***B26D 7/06*** | (2006.01) |
| ***B26D 7/28*** | (2006.01) |
| *B26D 7/01* | (2006.01) |

(52) U.S. Cl.

CPC *B65H 54/00* (2013.01); *B26D 1/06* (2013.01); *B26D 3/16* (2013.01); *B26D 5/32* (2013.01); *B26D 5/34* (2013.01); *B26D 7/0683* (2013.01); *B26D 7/28* (2013.01); *B65H 61/00* (2013.01); *B26D 2007/013* (2013.01)

(58) Field of Classification Search

CPC ..... B65H 54/00; B65H 54/71; B65H 61/00; B26D 1/06; B26D 3/16; B26D 5/32; B26D 5/34; B26D 7/0683; B26D 7/28; B26D 2007/013

USPC ..... 242/487.5

See application file for complete search history.

(56) References Cited

U.S. PATENT DOCUMENTS 4,385,426 A 5/1983 Vitellaro

FOREIGN PATENT DOCUMENTS

NL 137753 C 1/1973

OTHER PUBLICATIONS

International Search Report and Written Opinion for Application No. ITMI20120229, issued Oct. 8, 2012. (8 pages).

*Primary Examiner* — William E Dondero

(74) *Attorney, Agent, or Firm* — Mintz Levin Cohn Ferris Glovsky and Popeo, P.C.

(57) ABSTRACT

Machine for winding tubes (1) in spool form, comprising a structure (10) carrying a rotating reel (11), a device for feeding a tube (1) to the reel (11) in a longitudinal direction (X-X), a blade (12) for cutting the tube (1), movable in both senses along a transverse direction (Y-Y), a unit (20) for measuring the length of the tube (1), a device (22) for marking the tube (1) when a predefined length of the tube to be wound is reached, said device being arranged upstream of the machine, and a device (30) for detecting a marking (1*b*) applied to the tube (1), which device is arranged upstream of the cutting blade (12) at a predetermined distance (D) from said blade in the longitudinal direction (X-X).

7 Claims, 1 Drawing Sheet

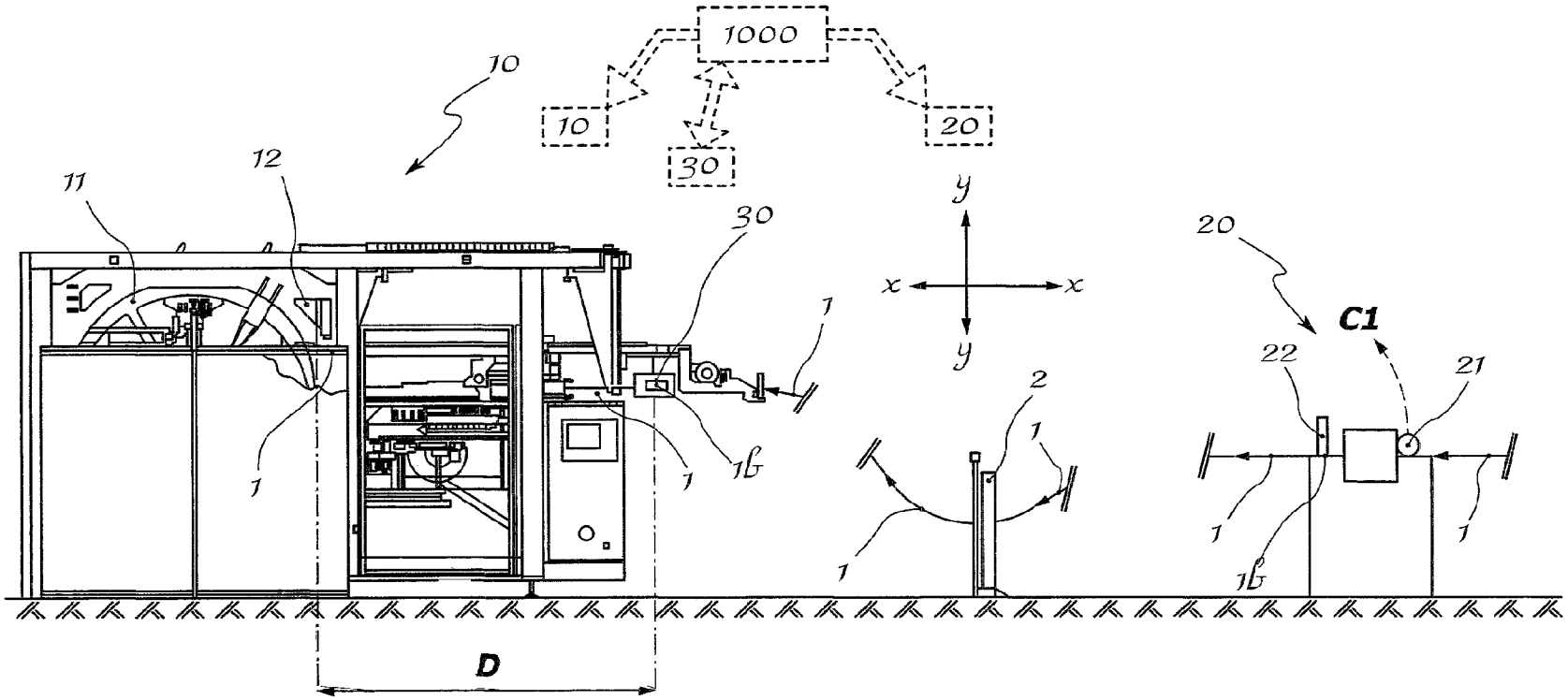
1000
20
30
10
10
x
y
y
x
20
C1
21
22
1
1
1b
2
1
1
30
1b
1
1
12
1
11
D

METHOD FOR PRECISELY CUTTING TO SIZE TUBES WOUND ONTO A SPOOL AND MACHINE FOR IMPLEMENTING SAID METHOD

RELATED APPLICATIONS

This application claims priority to Italian Patent Application No. MI2012A000229, filed on Feb. 16, 2012, the content of which is hereby incorporated by reference in its entirety.

The present invention relates to a method for precisely cutting to size tubes wound onto a spool and a tube winding machine which implements this method.

It is known in the technical sector relating to the winding of tubes, hanks and the like onto spools that this is achieved by winding the hank onto a reel rotating on a motor-driven hub of a winding machine.

It is also known that in the art there exist different designs of winders for automatically winding tubes made of plastic and other materials, these winders operating with a completely automatic cycle comprising substantially the following steps:

- automatic engagement of the tube to be wound onto the reel by means of an associated mechanical device;
- automatic start-up of the winding step during which a second tube-guiding device distributes the tube on the rotating reel;
- automatic cutting of the tube when the set winding length is reached;
- after the spool has been wrapped, automatic unloading of the roll produced, which therefore has the appearance of a perfectly wound tube of the desired length ready for palletization.

It is also known that one of the problems associated with these methods for winding tubes onto spools consists in the need to have precise measurements of the wound tube so as to obtain spools with a uniform and predefined tube length.

It is also known that, in order to perform cutting to size of the wound tube, the known art envisages using devices for measuring the tube fed to the winding machine and made to pass through a predefined arrival gate.

These known measuring and cutting methods, however, have the drawback arising from the fact that the measuring device is situated at a large distance from the cutting device, which is instead arranged on the machine, this resulting in a high degree of imprecision due to the longitudinal deformations of the tube which inevitably expands/retracts along the path between the measuring device and cutting device, resulting, after completion of winding, in spools with a length which is not uniform or in any case incorrect.

Further measuring and cutting methods use synchronization means with meter-counting wheels which are prone to frequent decalibration which alters the precision of the measurement and requires maintenance with consequent machine downtime.

Examples of the prior art are described in U.S. Pat. No. 4,385,426 and NL 137,753.

The technical problem which is posed, therefore, is that of developing a method and an apparatus for winding tubes and the like onto a spool, which allow precise cutting of the length of the wound tube in order to obtain spools with a constant and uniform length, irrespective of any possible deformations of the tube during winding.

In connection with this problem it is also required that this apparatus should have small dimensions, be easy and inexpensive to produce and assemble and be able to be installed easily at any user location also on already existing machines using standardized means.

These results are achieved according to the present invention by a method for winding and wrapping spools of tubes according to the characteristic features of Claim 1 and by a machine for winding and wrapping spools of tubes according to the characteristic features of Claim 3.

Further details may be obtained from the following description of a non-limiting example of embodiment of the subject of the present invention provided with reference to the accompanying drawings in which:

FIG. 1: shows a schematic side view of a machine for winding spools of tubes with an apparatus for measuring the cut according to the present invention.

As shown in FIG. 1 and assuming solely for the sake of convenience of description and without any limitation of meaning a pair of reference axes in a longitudinal direction X-X, corresponding to the extension of the tube 1 and direction of movement thereof, and a transverse direction Y-Y, corresponding to the direction of cutting of the tube 1 to be wound, a machine for winding tubes 1 onto a spool according to the invention comprises essentially:

- a support structure 10 incorporating the following:
  - a reel 11 rotating about an axis perpendicular to the longitudinal direction of feeding of the tube 1 which is in turn fed by means of driving means which are conventional per se and not described in detail;
  - a cutting blade 12 applied to the structure 10 and in turn operated in both senses of the transverse direction Y-Y by an associated electrical and/or pneumatic operating system.

The machine also has, mounted thereon, a device 30 for detecting a marking 1*b* which, as will emerge more clearly below, is applied onto the tube 1, which device is arranged upstream of the cutting blade 12 and at a predefined distance D from the cutting blade 12.

As shown, the machine is completed by a unit 20 for measuring the length of the tube 1, which comprises:

- at least one meter-counting device 21 which measures the length of the extruded tube 1 to be fed to the winding machine 10 and is able to emit a signal C1 when a predefined number of meters corresponding to the predefined length of tube 1 to be wound is reached;
- a marking device 22 which, when the predefined length of tube to be wound by means of the reel 11 is reached, applies a marking 1*b* on the surface of the tube 1.

The marking may consist of different types, for example invisible, coloured or conductive paint, microchips or the like, but in any case must be such that it may be detected by the device 30 for detecting the marking 1*b*.

According to the invention it is also envisaged that the sequences and operations of the machine and the measuring unit are performed by means of a control and operating device 1000 connected to transducer means for detecting signals emitted by sensors and controlling operations which may be electrical, hydraulic or equivalent, conventional per se and not shown or described in detail.

With this machine configuration a method for precisely cutting to size a tube fed to a winding machine equipped with a reel 11 and at least one cutting blade 12 comprises the following steps:

- equipping the winding machine with a sensor 30 for detecting a marking 1*b*, mounted at a predefined distance D from the cutting blade 12;

providing, upstream of the winding structure 10, a unit 20 for measuring the tube 1 fed to the machine and comprising at least one meter-counting device 21 and at least one marking device 22;

providing a control and operating device 1000 connected to the winding machine and to the measuring unit 20;

storing, in said control and operating device, predefined values for the length of the tube 1 to be wound, the speed of movement of the tube 1 fed for winding, and the relative distance D between the sensor 30 for reading the marking 1*b* and the cutting blade 12;

operation of a device for feeding the tube 1 to the measuring unit 20 and the machine 10 with the predefined speed of movement of the tube;

fastening the tube to the reel and starting the winding operation;

starting counting, by means of the meter-counting device 21, of the meters of tube 1 fed;

emission, by the control and operating device 1000, of a signal C1 when a predefined number of meters corresponding to the predefined length of tube 1 to be wound is reached;

sending said signal C1 to and operation, by the control unit 1000, of the marking device 22 so as to apply a marking 1*b* on the outer surface of the tube 1;

detection of the marking 1*b* by the sensing device 30 on the machine;

generation and sending, to the control unit 1000, a signal LM for reading of the marking by the read device 30;

operation of the cutting blade 12, by the control unit 1000, following a time interval calculated from emission of the signal LM for reading of the marking 1*b* and defined on the basis of the distance D between the marking reader 30 and the cutting blade 12 and the tube feeding speed;

cutting the tube.

It is therefore clear how, according to the invention, it is possible to provide the measuring and marking unit 20 at any more suitable distance from the machine 10 in keeping with the logistical requirements for installation of the entire plant; as shown, tube guide supports 2 may be arranged between the measuring unit and the winding machine. Said distance of the measuring and marking unit 20 from the machine 10, even if considerable, does not adversely affect, however, the cutting precision at the predefined measured length, since the marking sensor arranged on the machine at a predefined small distance D from the cutting blade always and in any case detects precisely the marking 1*b*, sending a consent signal to the control unit 1000 which operates said blade at the right time determined by the tube feeding speed and the corresponding distance D which are known to the control unit 1000.

The length of the tube wound onto the spool is therefore independent of any deformations of the tube which may alter the measuring precision and therefore the effective length of the spool.

Bearing in mind that this type of machine processes with a continuous cycle very large quantities of tube, being able to have a precise measurement of the length of the wound tube avoids more tube being wound than the programmed amount calculated when performing the cost evaluation of the spool, thereby avoiding manufacturing losses.

Although described in connection with certain constructional forms and certain preferred examples of embodiment of the invention, it is understood that the scope of protection of the present patent is defined solely by the following claims.

What is claimed is:

1. A machine for winding tubes in spool form, comprising:

a structure carrying a rotating reel, a device for feeding a tube to the reel in a longitudinal direction, a blade for cutting the tube, movable in both senses along a transverse direction, a unit for measuring the length of the tube, wherein the unit comprises a device for marking the tube when a predefined length of the tube to be wound is reached, said device being arranged upstream of the machine, and a device for detecting a marking applied to the tube, which device is arranged upstream of the cutting blade at a predetermined distance from said blade in the longitudinal direction.

2. The machine according to claim 1, further comprising a control and operating device connected to transducer means for detecting signals emitted by sensors and for performing operation of the moving parts.

3. The machine according to claim 2, wherein said unit for measuring the length of the tube comprises:

at least one meter-counting device which measures the length of the tube fed in the longitudinal direction.

4. The machine according to claim 3, wherein said marking device is operated by a signal, sent by the control unit, indicating that a predefined number of meters corresponding to the predefined length of tube to be wound has been reached.

5. The machine according to claim 1, wherein said marking consists of a coloured paint; a conductive paint; a coloured and conductive paint; or a microchip.

6. A method for cutting to size a tube fed in a longitudinal direction to a winding machine equipped with a reel and at least one cutting blade, comprising the following steps:

equipping the winding machine with a sensor for detecting a marking on the tube, said sensor being mounted at a predefined distance D from the cutting blade;

providing, upstream of the winding structure, a unit for measuring the tube fed to the machine and comprising at least one meter-counting device and at least one marking device;

providing a control and operating device connected to the winding machine and to the measuring unit;

storing, in said control and operating device, predefined values for the length of the tube to be wound, the speed of movement of the tube fed for winding, and the relative distance D, in the longitudinal direction (X-X), between the sensor for detecting the marking and the cutting blade;

operation of a device for feeding the tube to the measuring unit and to the winding machine at the predefined speed of movement;

fastening the tube onto the reel and starting the winding operation;

starting counting, by means of the meter-counting device, of the number of meters of tube fed;

emission, by the control and operating device, of a signal (C1) indicating that a predefined number of meters corresponding to the predefined length of tube to be wound has been reached;

sending the signal for the length reached and operation, by the control unit, of the marking device so as to apply the marking on the outer surface of the tube;

detection of the marking by the sensor on the machine;

generating and sending, to the control unit, a signal for reading of the marking by the read device, defining a time interval calculated as from emission of the signal (LM) for reading of the marking and defined on the basis of the distance between the sensor and the cutting blade and the speed of movement of the tube;

operation of the cutting blade, by the control unit, at the end of said calculated time interval; and cutting the tube.

7. The method according to claim 1, wherein said marking is obtained by means of coloured paint, conductive paint, or a microchip.

* * * * *